US010810952B2

(12) United States Patent
Lim

(10) Patent No.: US 10,810,952 B2
(45) Date of Patent: Oct. 20, 2020

(54) DISPLAY DEVICE AND METHOD

(71) Applicant: SAMSUNG ELECTRONICS CO., LTD., Suwon-si, Gyeonggi-do (KR)

(72) Inventor: Sung Jin Lim, Suwon-si (KR)

(73) Assignee: SAMSUNG ELECTRONICS CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 16/344,135

(22) PCT Filed: Jul. 6, 2017

(86) PCT No.: PCT/KR2017/007233
§ 371 (c)(1),
(2) Date: Apr. 23, 2019

(87) PCT Pub. No.: WO2018/079980
PCT Pub. Date: May 3, 2018

(65) Prior Publication Data

US 2019/0333456 A1 Oct. 31, 2019

(30) Foreign Application Priority Data

Oct. 26, 2016 (KR) ..... 10-2016-0140158

(51) Int. Cl.
*G09G 3/36* (2006.01)
*G09G 3/34* (2006.01)

(52) U.S. Cl.
CPC ..... *G09G 3/36* (2013.01); *G09G 3/3413* (2013.01); *G09G 2310/0237* (2013.01)

(58) Field of Classification Search
CPC ... G09G 2310/0237; G09G 2320/0233; G09G 3/3413; G09G 3/36
See application file for complete search history.

(56) References Cited

U.S. PATENT DOCUMENTS 5,619,276 A * 4/1997 Christopher ..... H04N 3/30 348/541
8,766,906 B2 7/2014 Yoshida et al.
(Continued)

FOREIGN PATENT DOCUMENTS

KR 10-2010-0030703 3/2010
KR 10-2011-0124933 11/2011
(Continued)

OTHER PUBLICATIONS

US 8,638,291 B2, 01/2014, Yoshida et al. (withdrawn)
(Continued)

*Primary Examiner* — Kent W Chang
*Assistant Examiner* — Scott D Au
(74) *Attorney, Agent, or Firm* — Nixon & Vanderhye, P.C.

(57) ABSTRACT

A display device according to one aspect of the disclosure includes a liquid crystal panel, a backlight including at least one light source to irradiate light to the liquid crystal panel, a timing controller to scan, in each frame period based on a synchronization signal which is input, the liquid crystal panel at a scan rate faster than a frame rate based on the synchronization signal, and a backlight control unit to turn on the backlight till a second time point, which is a scan time point of a next frame, from a first time point when a specified time elapses from a time point in which scan of the liquid crystal panel is finished in each frame period.

12 Claims, 9 Drawing Sheets

(56) References Cited

U.S. PATENT DOCUMENTS

| | | | | |
|---|---|---|---|---|
| 8,823,780 | B2 | 9/2014 | Lee | |
| 9,142,188 | B2 | 9/2015 | Kurikko | |
| 9,355,602 | B2 | 5/2016 | Yoshida et al. | |
| 9,570,017 | B2 | 2/2017 | Yoshida et al. | |
| 2007/0152951 | A1* | 7/2007 | Ahn | G09G 3/342 345/102 |
| 2008/0180385 | A1 | 7/2008 | Yoshida et al. | |
| 2011/0205344 | A1 | 8/2011 | Lee | |
| 2011/0279467 | A1 | 11/2011 | Kim et al. | |
| 2013/0021386 | A1* | 1/2013 | Min | G09G 3/36 345/690 |
| 2013/0070174 | A1 | 3/2013 | Yoshida et al. | |
| 2013/0100150 | A1 | 4/2013 | Kurikko | |
| 2013/0147857 | A1 | 6/2013 | Kurikko | |
| 2013/0321365 | A1* | 12/2013 | Chang | G09G 3/3674 345/204 |
| 2014/0139568 | A1 | 5/2014 | Yoshida et al. | |
| 2015/0194119 | A1* | 7/2015 | Ahn | G09G 3/3696 345/213 |
| 2016/0014384 | A1* | 1/2016 | Hosoki | G09G 3/3413 348/791 |
| 2016/0267853 | A1 | 9/2016 | Yoshida et al. | |

FOREIGN PATENT DOCUMENTS

| | | |
|---|---|---|
| KR | 10-1356321 | 1/2014 |
| KR | 10-1422600 | 7/2014 |
| KR | 10-2015-0076442 | 7/2015 |
| KR | 10-1539606 | 7/2015 |

OTHER PUBLICATIONS

International Search Report for PCT/KR2017/007233 dated Oct. 19, 2017, 4 pages.

Written Opinion of the ISA for PCT/KR2017/007233 dated Oct. 19, 2017, 7 pages.

* cited by examiner

720 →

710 ↓

| | 0 | 16 | 32 | 48 | 64 | 80 | 96 | 112 | 128 | 140 | 160 | 176 | 192 | 208 | 224 | 240 | 255 |
|---|---|---|---|---|---|---|---|---|---|---|---|---|---|---|---|---|---|
| 0 | 0 | 1 | 2 | 3 | 5 | 7 | 7 | 7 | 6 | 6 | 4 | 3 | 2 | 1 | 0 | 0 | 0 |
| 16 | 0 | 0 | 1 | 2 | 3 | 3 | 4 | 4 | 3 | 2 | 0 | 0 | 0 | 0 | 0 | 0 | 0 |
| 32 | 0 | 0 | 0 | 0 | 0 | 0 | 0 | 0 | 0 | 0 | 0 | 0 | 0 | 0 | 0 | 0 | 0 |
| 48 | 0 | 1 | 0 | 0 | 0 | 0 | 0 | 0 | 0 | 0 | 0 | 0 | 0 | 0 | 0 | 0 | 0 |
| 64 | 0 | 1 | 0 | 0 | 0 | 0 | 0 | 0 | 0 | 0 | 0 | 0 | 0 | 0 | 0 | 0 | 0 |
| 80 | 0 | 1 | 0 | 0 | 0 | 0 | 0 | 0 | 0 | 0 | 0 | 0 | 0 | 0 | 0 | 0 | 0 |
| 96 | 0 | 1 | 0 | 0 | 0 | 0 | 0 | 0 | 0 | 0 | 0 | 0 | 0 | 0 | 0 | 0 | 0 |
| 112 | 0 | 1 | 1 | 2 | 0 | 0 | 0 | 0 | 0 | 0 | 0 | 0 | 0 | 0 | 0 | 0 | 0 |
| 128 | 0 | 1 | 1 | 2 | 0 | 0 | 0 | 0 | 0 | 0 | 0 | 0 | 0 | 0 | 0 | 0 | 0 |
| 144 | 0 | 1 | 1 | 2 | 3 | 0 | 0 | 0 | 0 | 0 | 0 | 0 | 0 | 0 | 0 | 0 | 0 |
| 160 | 0 | 1 | 1 | 2 | 3 | 3 | 0 | 0 | 0 | 0 | 0 | 0 | 0 | 0 | 0 | 0 | 0 |
| 176 | 0 | 1 | 1 | 2 | 3 | 3 | 3 | 0 | 0 | 0 | 0 | 0 | 0 | 0 | 0 | 0 | 0 |
| 192 | 0 | 1 | 1 | 2 | 3 | 3 | 3 | 3 | 0 | 0 | 0 | 0 | 0 | 0 | 0 | 0 | 0 |
| 208 | 0 | 1 | 1 | 2 | 3 | 3 | 3 | 3 | 0 | 0 | 0 | 0 | 0 | 0 | 0 | 0 | 0 |
| 224 | 0 | 1 | 1 | 2 | 3 | 3 | 3 | 3 | 3 | 0 | 0 | 0 | 0 | 0 | 0 | 0 | 0 |
| 240 | 0 | 1 | 1 | 2 | 3 | 3 | 3 | 3 | 3 | 2 | 0 | 0 | 0 | 0 | 0 | 0 | 0 |
| 255 | 0 | 1 | 1 | 2 | 3 | 3 | 3 | 3 | 3 | 2 | 1 | 0 | 0 | 0 | 0 | 0 | 0 |

FIG.7

COMPENSATION LUT

L1 L2

| | 0 | 16 | 32 | 48 | 64 | 80 |
|---|---|---|---|---|---|---|
| 0 | 0 | 2 | 4 | 8 | 12 | 14 |
| 16 | 0 | 0 | 0 | 2 | 6 | 6 |
| 32 | 0 | 0 | 0 | 0 | 0 | 0 |
| 48 | 0 | 0 | 0 | 0 | 0 | 0 |
| 64 | 0 | 2 | 0 | 0 | 0 | 0 |

L4 L3

FIG.8A

L1 L2

| | 48,49 | 50,51 | 52,53 | 54,55 | 56,57 | 58,59 | 60,61 | 62,63 |
|---|---|---|---|---|---|---|---|---|
| 0,1 | 8 | | | | | | | 12 |
| 2,3 | 7 | | | | | | | 11 |
| 4,5 | 6 | | | | | | | 10 |
| 6,7 | 5 | | | | | | | 9 |
| 8,9 | 5 | 6 | 6 | 7 | 7 | 8 | 8 | 9 |
| 10,11 | 4 | | | | | | | 8 |
| 12,13 | 3 | | | | | | | 7 |
| 14,15 | 2 | | | | | | | 6 |

L4 L3

FIG.8B

DISPLAY DEVICE AND METHOD

This application is the U.S. national phase of International Application No. PCT/KR2017/007233 filed Jul. 6, 2017 which designated the U.S. and claims priority to KR Patent Application No. 10-2016-0140158 filed Oct. 26, 2016, the entire contents of each of which are hereby incorporated by reference.

TECHNICAL FIELD

Various embodiments in the disclosure relate to a display device and a display method, capable of improving Motion Blur of a liquid crystal display.

DESCRIPTION OF RELATED ART

A cathode ray tube (CRT) is an impulse-type display device to display data by light emitted by exciting a phosphor for a very short initial time in one period and to be in a stationary state for a remaining long time.

To the contrary, a liquid crystal display may apply data to liquid crystal for a scanning duration (e.g., 80%) in which a scan voltage is applied and then may hold the applied data for a blank duration (e.g., 20%).

In a hold-type device such as the liquid crystal display (LCD), a Motion Blur phenomenon occurs due to the holding characteristic of liquid crystal, so a displayed image may be blurred. In the LCD, a liquid crystal waveform is varied at each position due to a long scan time. As a panel size is increased, the difference between the liquid crystal waveforms is more increased over time, thereby causing Motion Blur.

The LCD may improve Motion Blur by repeating the procedure of turning off a backlight every frame, that is, by turning off the backlight at specific time intervals. In this case, the brightness of the LCD may be reduced due to backlight off.

The LCD may improve Motion Blur by inserting a black frame (BF) between data frames (DF). In this case, the brightness of the LCD may be lowered due to the insertion of the BF.

SUMMARY

Embodiments disclosed in the disclosure may provide a display device and a display method, capable of improving liquid crystal blur by more reducing a liquid crystal scan time than a liquid crystal scan time based on an input control signal.

According to an embodiment of the disclosure, a display device includes a liquid crystal panel, a backlight including at least one light source to irradiate light to the liquid crystal panel, a timing controller to scan, in each frame period based on a synchronization signal which is input, the liquid crystal panel at a scan rate faster than a frame rate based on the synchronization signal, and a backlight control unit to turn on the backlight till a second time point, which is a scan time point of a next frame, from a first time point when a specified time elapses from a time point in which scan of the liquid crystal panel is finished in each frame period.

According to another embodiment of the disclosure, a display method by at least one processor includes scanning, in each frame period based on a synchronization signal which is input, a liquid crystal panel at a scan rate faster than a frame rate based on the synchronization signal, and turning on a backlight till a second time point, which is a scan time point of a next frame, from a first time point when a specified time elapses from a time point in which scan of the liquid crystal panel is finished in each frame period.

According to various embodiments, Motion Blur may be improved by reducing the liquid crystal scan time.

BRIEF DESCRIPTION OF THE DRAWINGS

FIG. 7 is a view illustrating a look-up table, according to an embodiment of the disclosure;

FIGS. 8A and 8B are views illustrating a process of calculating a compensation value, according to an embodiment of the disclosure.

DETAILED DESCRIPTION OF EXAMPLE EMBODIMENTS

Figure 1:
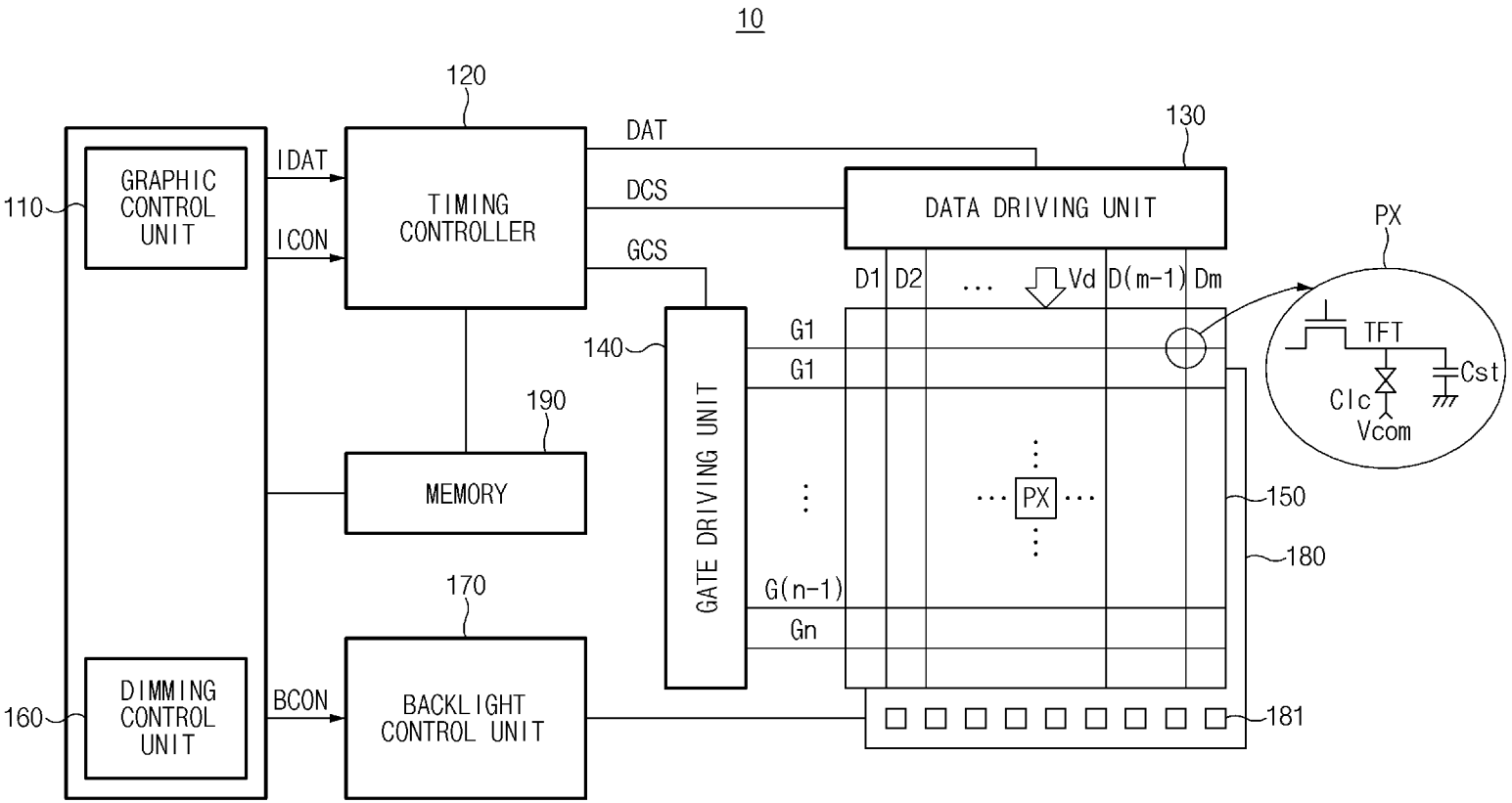
FIG. 1 is a block diagram illustrating a display device, according to an embodiment of the disclosure.

Hereinafter, various embodiments of the disclosure may be described with reference to accompanying drawings. Accordingly, those of ordinary skill in the art will recognize that the disclosure is not limited to a specific embodiment, modifications, equivalents, and/or alternatives on an embodiment in the disclosure can be variously made without departing from the scope and spirit of the disclosure. In the following description made with respect to the accompanying drawings, similar components will be assigned with similar reference numerals.

FIG. 1 is a block diagram illustrating a display device, according to an embodiment of the disclosure.

As illustrated in FIG. 1, according to an embodiment, a display device 10 may include a liquid crystal panel 150, a data driving unit 130, a gate driving unit 140, a graphic control unit 110, a dimming control unit 160, a memory 190, a timing controller 120, a backlight 180, and a backlight control unit 170. According to an embodiment, at least one component of the display device 10 may be excluded from the above components. For example, when the display device 10 is a control device (or a system on chip (SoC)) applied to upgrade another display device, the backlight 180, the data driving unit 130, the gate driving unit 140, the liquid crystal panel 150, and the backlight control unit 170 may be omitted. In this case, the another display device may include the backlight 180, the data driving unit 130, the gate driving unit 140, the liquid crystal panel 150, and the backlight control unit 170. An input/output relation illustrated in FIG. 1 is provided by way of example for the convenience of explanation, but the disclosure is not limited thereto.

According to an embodiment, the data driving unit 130, the gate driving unit 140, the graphic control unit 110, the dimming control unit 160, and the timing controller 120 may be at least one hardware module of at least one processor or a software module implemented by at least one processor. For example, the function performed by each module included in the data driving unit 130, the gate driving unit 140, the graphic control unit 110, the dimming control unit 160, and the timing controller 120 may be performed by one processor or may be performed by respective processors. The processor may include, for example, at least one of a central processing unit (CPU), a graphics processing unit (GPU), a micro-processor, an application specific integrated circuit (ASIC), or a field programmable gate array (FPGA), or an LCD driver (e.g., DDI), and may have a plurality of cores.

According to an embodiment, the liquid crystal panel 150 may include a switching device (e.g., a thin film transistor (TFT) (not illustrated)), a liquid crystal capacitor Clc connected with the switching device, and a storage capacitor Cst in each pixel P defined by at least one data line D1 to and at least one gate line G1 to Gn. Switching devices may supply data voltages Vd from the data lines D1 to Dm in response to gate voltages from the gate lines G1 to Gn. The liquid crystal capacitor Clc is charged with a differential voltage between a data voltage supplied to a pixel electrode and a common voltage supplied to a common electrode and adjusts the light transmittance of liquid crystal based on the differential voltage, thereby implementing a desired image. The storage capacitor Cst may hold the voltage charged in the liquid crystal capacitor Clc until the next data voltage Vd is supplied.

According to an embodiment, the data driving unit 130 may receive an image signal DAT for a pixel of each line in response to a data control signal DCS from the timing controller 120. For example, the data driving unit 130 may convert the image signal DAT into a data voltage Vd to be transmitted to the data lines D1 to Dm, by selecting a grayscale voltage corresponding to the image signal DAT (or a grayscale value) from the timing controller 120 and may apply the data voltage Vd to the data lines D1 to Dm.

According to an embodiment, the data driving unit 130 may control the polarity of the data voltage Vd, which is applied to each pixel PX, to be opposite to the polarity of a previous frame, in response to an inverted signal of the data control signal DCS (called "frame inversion"). According to an embodiment, the polarity of the data voltage Vd applied to the whole pixels PX may be inverted in the frame inversion of the liquid crystal panel 150. Based on the characteristic of the inverted signal, the polarity of the data voltage Vd applied to the data lines D1 to Dm may be changed periodically even within one frame, or may be changed in the unit of a pixel line.

According to an embodiment, the gate driving unit 140 may turn on a switching device connected with each of the gate lines G1 to Gn by applying a gate-on voltage to the gate lines G1 to Gn in response to a gate control signal GCS received from the timing controller 120. Then, the data voltage Vd applied to the gate lines G1 to Gn may be applied to a relevant pixel through the turned-on switching device to serve as a voltage (pixel voltage) charged in each pixel. After a data voltage is applied to a pixel of the liquid crystal panel 150, the pixel may represent brightness corresponding to the data voltage through various optical conversion elements. According to an embodiment, the gate driving unit 140 may repeat the above-described procedure in every horizontal period (which is the same as one period of a horizontal synchronization signal Hsync and a data enable signal) to sequentially apply the gate-on voltage Von to all gate lines G1 to Gn of the liquid crystal panel 150 and to apply the data voltage Vd to all pixels Px, thereby displaying an image of one frame.

According to an embodiment, the graphic control unit 110 may process at least one of image data received from the outside or image data stored in the memory 190 to generate an input image signal IDAT and then to send the input image signal IDAT to the timing controller 120 together with an input control signal ICON. The input control signal ICON may include at least one of a vertical synchronization signal Vsync, a horizontal synchronization signal Hsync, a dot clock DCLK, or a data enable signal DE. The graphic control unit 110 may be, for example, a central processing unit of the display device 10. The input image signal may have R, G, and B values for representing various resolutions such as High Definition (HD), Full-HD (FHD), and Ultra-HD (UHD).

According to an embodiment, the memory 190 may store a compensation look-up table (hereinafter, referred to as an "LUT"). The compensation LUT may store a compensation value for compensating for the shortage or the excess in the charging ratio of each pixel, which is made due to the difference between a reference pixel (a pixel affecting a pre-charge) and a target pixel (a pre-charged pixel). The compensation value may be determined through an experiment of compensating for the charging ratio identified for data compensation as the short charging ratio of the liquid crystal panel 150 is identified when the scan time of the liquid crystal panel 150 is reduced. According to an embodiment, the size of the compensation LUT stored in the memory 190 and the compensation value may be varied and adjusted depending on the characteristic of the liquid crystal panel 150. The compensation LUT may be variously determined depending on the color of the reference pixel for image signal compensation.

According to an embodiment, the memory 190 may store a delay time for each gate, which is a time for delaying turning on the gate, based on the position of the gate or the scan order. For example, the delay time for each gate may be a time for delaying a time to turn on remaining gates based on a gate first turned on. The delay time for each gate may be determined through an experiment of compensating for the shortage of the charging ratio of the liquid crystal panel 150 by identifying the shortage of the charging ratio of the liquid crystal panel 150, and by advancing or delaying the time for pre-charge when the scan time is reduced. For example, the delay time for the gate may be set to advance a time to turn on the gate with respect to the gate more requiring the pre-charge, based on the position of the gate (or the scan order). The delay time for each gate may be set to delay the time to turn on the gate with respect to the gate which less requires the pre-charge or does not require the pre-charge. The memory 190 may store a parameter, such as the scan order of the liquid crystal panel 150, associated with the scan of the liquid crystal panel 150.

According to an embodiment, the timing controller 120 may generate and output the image signal DAT in a line unit based on an input control signal ICON (e.g., Hsync), when receiving the input image signal IDAT and the input control signal ICON from the graphic control unit 110. The output image signal DAT may include grayscale values to be applied to pixel electrodes of red, green, and blue pixels in the liquid crystal panel 150.

According to an embodiment, the timing controller 120 may generate and output timing control signals DCS and GCS to control the operating timing of the data driving unit 130 and the gate driving unit 140, when outputting the image signal to the liquid crystal panel 150. The timing control signals may include a data control signal DCS to control the operating timing of the data driving unit 130 and a gate control signal GCS to control the operating timing of the gate driving unit 140. The data control signal DCS may include a source start pulse signal, a source sampling clock signal, and a source output enable signal. The gate control signal GCS may include a gate start pulse signal, a gate shift clock signal, and a gate output enable signal. The output image signal may have R, G, and B values representing the same resolution as that of the input signal or may have R, G, B values (grayscale values) representing adjusted resolution.

According to an embodiment, the timing controller 120 may update the liquid crystal panel 150 depending on the image signal DAT output at a frame rate based on the input control signal (e.g., Vsync). In this case, the timing controller 120 may output the image signal DAT to the liquid crystal panel 150 at a scan rate increased to at least twice faster than the frame rate based on the input control signal. According to an embodiment, the timing controller 120 may increase a liquid crystal scan rate by setting the timing control signals DCS and GCS to increase the frame rate based on the synchronization signal. For example, the timing controller 120 may set the source sampling clock and the gate shift clock to at least twice faster than a dot clock DCLK based on the synchronization signal, and may output an image signal and a gate-on voltage in response to the set source sampling clock and the set gate shift clock. Accordingly, according to an embodiment of the disclosure, the liquid crystal scan time may be reduced, so the bandwidth of the data duration (scanning duration) is increased in each frame period, thereby stably ensuring the scanning duration of the liquid crystal panel 150. The liquid crystal scan time may be a time taken to apply the data voltage to all pixels in the liquid crystal panel 150 as the output image signal is sent to the liquid crystal panel 150 by the data driving unit 130, and the gate-on voltage is applied to the liquid crystal panel 150 by the gate driving unit 140. To scan the liquid crystal panel 150 may be to apply the data voltage to each pixel of the liquid crystal panel 150.

According to an embodiment, the timing controller 120 may calculate a compensation value for compensating for the shortage or the excess of the charging ratio of each pixel based on the scan order of the image signal DAT and may compensate for a grayscale value of each pixel by using the calculated compensation value. For example, the timing controller 120 may identify a grayscale value of an image signal of each of pixels, which are connected with mutually different gate lines and the same data line, from each frame of an input image signal, and may calculate compensation values corresponding to the identified grayscale values from the compensation LUT. The timing controller 120 may compensate for the shortage or the excess of the charging ratio as an add operation or a subtraction operation is performed with respect to the grayscale value of each pixel. Accordingly, according to an embodiment, the timing controller 120 may send the compensated grayscale value of each pixel to the data driving unit 130. As described above, according to an embodiment, as the charging ratio is compensated through the comparison between grayscale values based on the reduced scan time, the charging ratio may be accurately compensated with respect to the liquid crystal panel 150 and color reproduction and a gamma characteristic may be improved.

According to an embodiment, as the timing controller 120 outputs a gate control signal corresponding to the delay time for each gate, the charging ratio of each pixel, which is reduced due to the reduction of the scan time, may be compensated. Therefore, according to an embodiment of disclosure, Motion Blur of the liquid crystal panel 150 may be improved while the short charging ratio is compensated, thereby preventing the brightness from being lowered due to the reduction of the scan time.

According to an embodiment, the backlight 180 may include a plurality of light sources 181 to emit light irradiated to the liquid crystal panel 150 (backlight) and an optical member (not illustrated) disposed on the light sources to guide light, which is emitted from the light sources, toward the liquid crystal panel 150 to improve the light efficiency. According to an embodiment, the backlight 180 may be positioned adjacent to at least one of a plurality of side surfaces of the liquid crystal panel 150. According to an embodiment, the light sources included in the backlight 180 may be subject to global dimming such that the light sources are simultaneously turned on and turned off.

According to an embodiment, the dimming control unit 160 may send a backlight control signal BCON to the backlight control unit 170. The backlight control unit 170 may turn on or turn off the backlight 180 in response to the backlight control signal. For example, the dimming control unit 160 may output the backlight control signal to turn on the backlight at a time point, in which the scan of each frame is finished, or at a time point when a specified time elapses from the time point in which the scan of the frame is finished.

According to an embodiment, the dimming control unit 160 may adjust a time point (backlight turn time point or time) to turn on the backlight by analyzing each frame of an input image signal. For example, the dimming control unit 160 may detect the motion of each frame and may detect a blurring area, which has a higher motion blur possibility, of a plurality of detection areas included in each frame (image). The plurality of detection areas, which are areas obtained by dividing the liquid crystal panel 150 in a line unit, may be, for example, upper, intermediate, and lower areas. The dimming control unit 160 may set a backlight turn on time to be delayed corresponding to the time in which the scan of the blurring area scanned later in the plurality of detection areas is finished. The dimming control unit 160 may be, for example, a central processing unit (see a block including reference numerals 110 and 160 of FIG. 1) of the display device 10. For example, when the blurring area is first scanned in the plurality of detection areas, the dimming control unit 160 may output a backlight control signal such that the backlight is turned on at a time point delayed by a specified time ($t>0$) from the time in which the scan of each frame is finished. As another example, when the blurring area is scanned later in the plurality of detection areas, the dimming control unit 160 may output the backlight control signal such that the specified time is prolonged by the difference in scan time (or charging time) between an area, which is first scanned, and the blurring area and the backlight may be turned on at a time point corresponding to the prolonged specified time.

According to an embodiment, the backlight control unit 170 may turn on the backlight 180 in response to the backlight control signal. For example, the backlight control unit 170 may be an inverter to turn on the backlight 180 in response to the backlight control signal. According to an embodiment, the backlight control signal may be a signal to turn on the backlight 180 after a specified first time elapses from a time point in which the scan of the liquid crystal panel 150 is finished. The backlight control signal may be a signal to turn on and turn off the backlight 180 at least one time till a scan time point of a next frame after the first time elapses from a time point in which the scan of a present frame is finished. For example, the backlight control signal may be a signal for blinking the backlight 180 two times till the scan time point of the next frame after the first time elapses from the time point in which the scan of the present frame is finished.

According to an embodiment of the disclosure, as a liquid crystal scan time is reduced in each frame period, the blank duration may be increased after the scanning of liquid crystal is finished, so a data bandwidth may be increased. According to an embodiment, as the backlight is variously turned on after the scan of the liquid crystal is finished (while avoiding a blur duration of the liquid crystal), the liquid crystal blur may be prevented due to the scanning duration of the liquid crystal.

Figure 2:
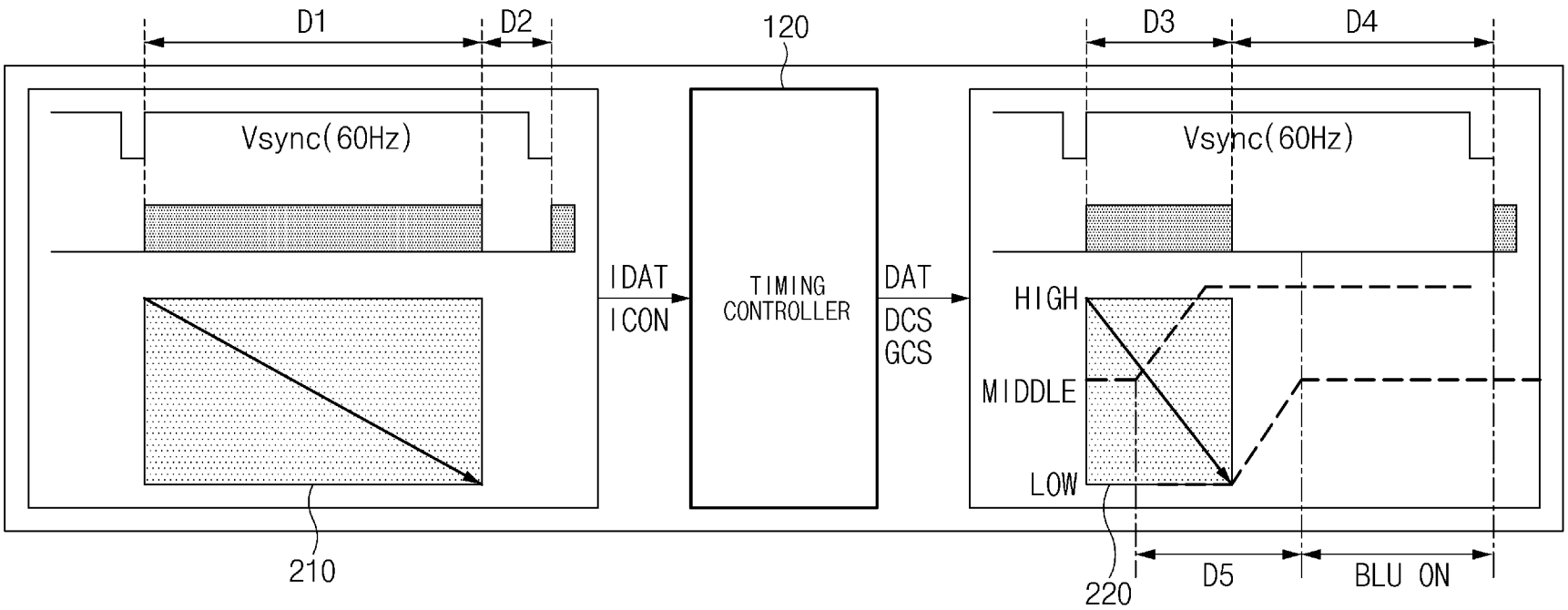
FIG. 2 is a view illustrating scan and backlight control timing, according to an embodiment of the disclosure.

FIG. 2 is a view illustrating scan and backlight control timing, according to an embodiment of the disclosure. FIG. 2 illustrates the case of the frame rate based on the synchronization signal is 60 Hz. In FIG. 2, an arrow marked on the liquid crystal panel 150 indicates a scanning direction of the liquid crystal panel 150, and a hatched portion indicates an image signal displayed on the liquid crystal panel 150.

Referring to FIG. 2, when receiving an input image signal IDAT scanned at a scan rate as in state 210, the timing controller 120 may output an image signal DAT such that the scan time may be reduced to a half or less of the scan time based on an input control signal as in state 220. The timing controller 120 may increase the blank duration of the liquid crystal panel 150 by reducing the scan time while maintaining the frame rate (D3+D4=D1+D2) of the liquid crystal panel 150.

As in state 210 of FIG. 2, each frame period may include a scanning duration D1 occupying about 80% thereof and a blank duration D2 occupying 20% thereof, based on the input control signal ICON (e.g., Vsync). About 80% of each frame period based on the input control signal ICON is the scanning duration, so a portion of the duration, in which the backlight is turned on, may be probably superposed with the scanning duration in each frame period. In this case, a user may probably recognize the blurring of the liquid crystal panel 150 as the duration, in which a pixel scanned later in the liquid crystal panel 150 is charged, is exposed to the user when the backlight is turned on.

However, according to an embodiment, the timing controller 120 may output the timing control signals DCS and GCS such that the scan time is reduced to a half or less the scan time. The timing controller 120 may output a timing control signal allowing the scanning duration D3 to occupy 50% or less of the frame period and allowing the blank duration D3 to occupy 50% or more of the frame period as in state 220 of FIG. 2.

In addition, as in state 220 of FIG. 2, according to an embodiment, the dimming control unit 160 may output a backlight control signal BLU ON to turn on the backlight 180 till a scan time point of a next frame after the first time, which is specified, elapses from the time point in which the scanning duration D3 is finished. Accordingly, the backlight control unit 170 may turn on the backlight 180 after the blurring duration D5 of the liquid crystal panel 150. As described above, according to an embodiment, the backlight 180 may be turned on while avoiding the burring duration D5 of the liquid crystal panel 150, thereby preventing the blurring duration D5 of the liquid crystal panel 150 from being exposed to a user. In addition, Motion Blur is prevented from being exposed due to the characteristic of the liquid crystal panel 150.

According to another embodiment, the dimming control unit 160 may output the backlight control signal allowing the backlight to blink at least once in the backlight ON duration (BLU ON). Accordingly, according to an embodiment, the backlight control unit 170 may turn on the backlight 180 while avoiding the blurring duration D5 of the liquid crystal panel 150, thereby reducing the probability that Motion Blur occurs.

Figure 3:
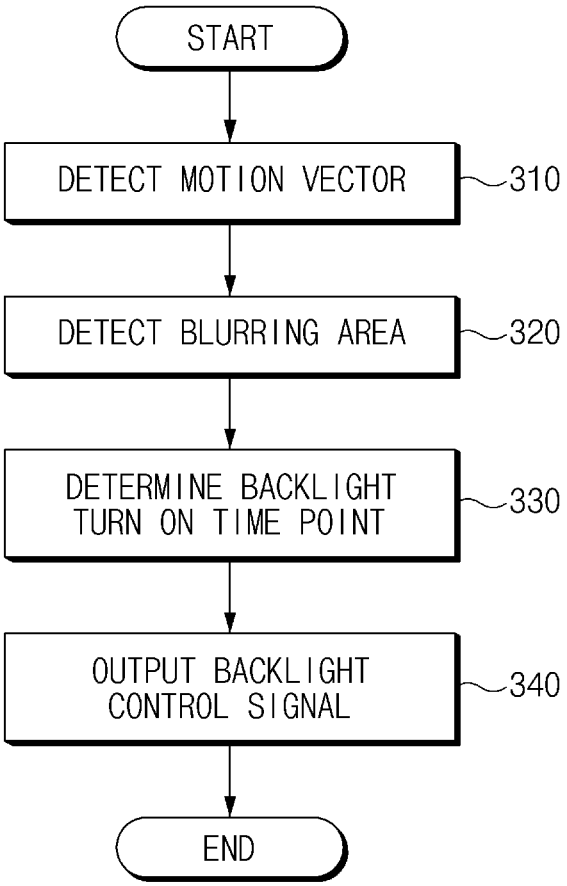
FIG. 3 is a flowchart illustrating a method for adjusting a backlight turn on time, according to an embodiment of the disclosure.

FIG. 3 is a flowchart illustrating a method for adjusting a backlight turn on time, according to an embodiment of the disclosure.

Referring to FIG. 3, in operation 310, the dimming control unit 160 may detect a plurality of motion vectors by using the difference between a previous frame and a present frame, when identifying each frame sent from the graphic control unit 110 to the timing controller 120.

In operation 320, the dimming control unit 160 may detect a blurring area, which has high motion blur probability, of a plurality of detection areas by using the plurality of motion vectors. In operation 320, the dimming control unit 160 may detect the blurring area from the plurality of detection areas by using the size of the detected motion. For example, the dimming control unit 160 may detect, as the blurring area, an area, in which the detected motion is equal to or greater than a specified threshold motion, of the plurality of detection areas. The dimming control unit 160 may detect, as the blurring area, an area having bigger motion than the motion of another detection area by the specified threshold motion or more. The threshold motion may be determined through an experiment of visibly identifying Motion Blur in an image frame displayed on the liquid crystal panel 150. The blurring area may an area having a caption in each image frame, or may be an area having an object (e.g., a wave in the image of a beach) having a bigger motion in each image frame.

In operation 330, when the blurring area is present, the dimming control unit 160 may set a backlight turn on time point based on the scan order of the blurring area, and may output a backlight control signal corresponding to the backlight turn on time point. In operation 330, the dimming control unit 160 may more delay the backlight turn on time point as the scan order of the blurring area becomes later. For example, when the blurring area is first scanned in each frame, the dimming control unit 160 may set the backlight turn on time point corresponding to a time point in which the scan of the frame is finished. When the blurring area is scanned after the first in each frame, the dimming control unit 160 may set the backlight turn on time point to be delayed corresponding to the difference in scan time between an area, which is first scanned, and the blurring area.

In operation 340, the dimming control unit 160 may output the backlight control signal corresponding to the determined backlight turn on time point. Therefore, according to an embodiment, when a blurring area based on the characteristic (motion) of an image frame is scanned later in a liquid crystal panel, as the backlight is turned on later, Motion Blur exposed to the user may be reduced.

According to an embodiment, the dimming control unit 160 may detect the above-described blurring area and may determine the backlight turn on time point, with respect to every frame sent to the timing controller 120. According to an embodiment, when at least two blurring areas are present, the dimming control unit 160 may set a backlight on time point based on a blurring area, which is first scanned, of the blurring areas.

In detail, a plurality of detection areas are upper, intermediate, and lower areas, each of which includes a plurality of lines in each frame. The detection areas may be scanned in order of the upper area, the intermediate area, and the lower area. In this case, when any blurring area is absent from each frame or when the blurring area is the upper area which is first scanned, the dimming control unit 160 may set the backlight turn on time point to a specified time (e.g., 1 ms) corresponding to the time in which the scan of each frame is finished. The specified time may set to correspond to a time in which the charging of the liquid crystal panel 150, in which each frame has been input, is finished. When the blurring area is the intermediate area or the lower area, the dimming control unit 160 may increase the specified time in the unit (m*t1) of a specified adjustment time t1 (e.g., 0.5 ms) corresponding to the difference in a scan time (or charging time) between two areas. For example, the dimming control unit 160 may delay the specified time by t1 corresponding to the difference in the scan time (or charging time) between the upper area and the intermediate area when the blurring area is the intermediate area, and may delay the specified time by 2*t1 corresponding to the difference in the scan time (or charging time) between the upper area and the lower area when the blurring area is the lower area.

According to an embodiment, the backlight may be turned on while avoiding the blur duration of the LCD, so Motion Blur may be reduced. According to an embodiment, even if the backlight is controlled in a global diming scheme, Motion Blur may be reduced by adjusting the backlight turn on time.

Differently from the above-described embodiment, an embodiment of the disclosure may be used even when the backlight is controlled to be turned on in a block dimming scheme. For example, the liquid crystal scan time may be reduced even under the block dimming control, thereby ensuring a time for various control operations based on the block dimming.

Figure 4:
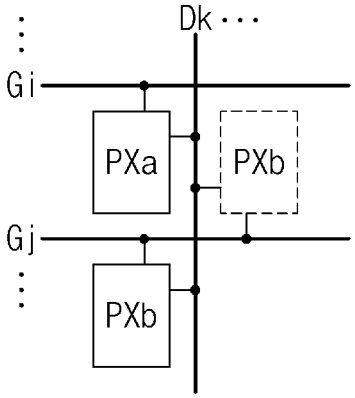
FIG. 4 is a view illustrating a pixel of a liquid crystal panel, according to an embodiment of the disclosure.
Figure 5:
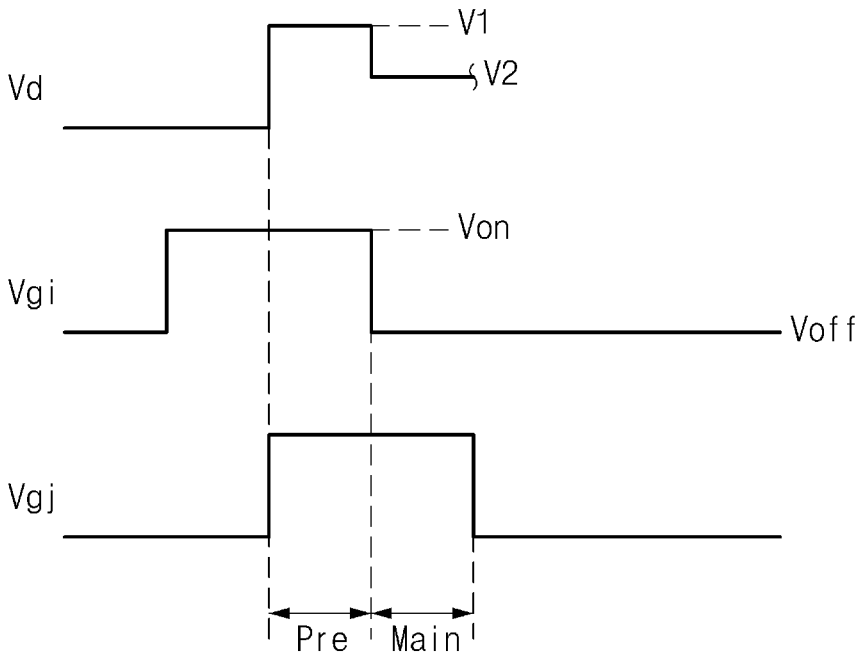
FIG. 5 is a view illustrating a data voltage and a gate voltage, according to an embodiment of the disclosure.
Figure 6A:
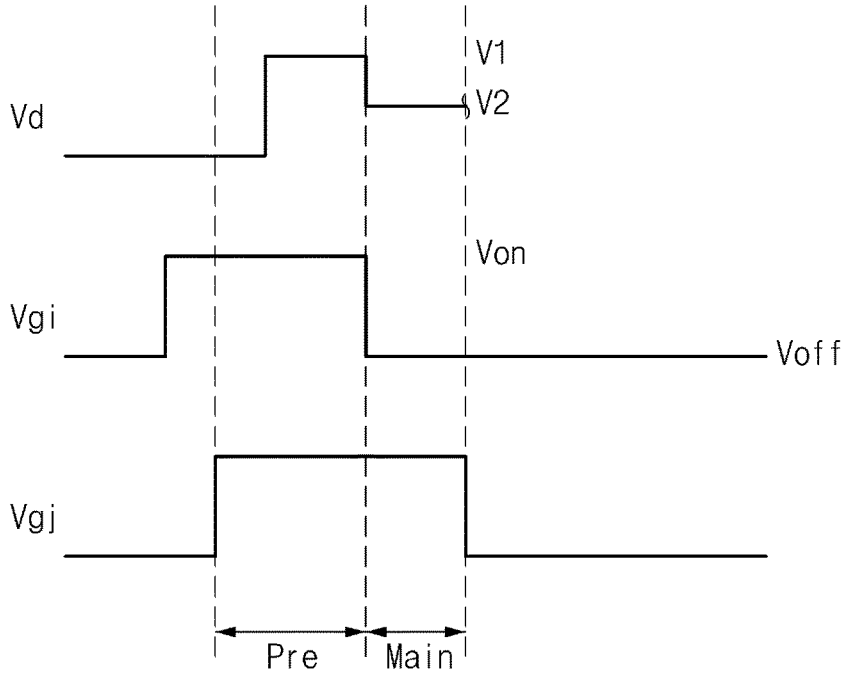
FIGS. 6A and 6B are views illustrating a method for adjusting a delay time for each gate, according to an embodiment of the disclosure.
Figure 6B:
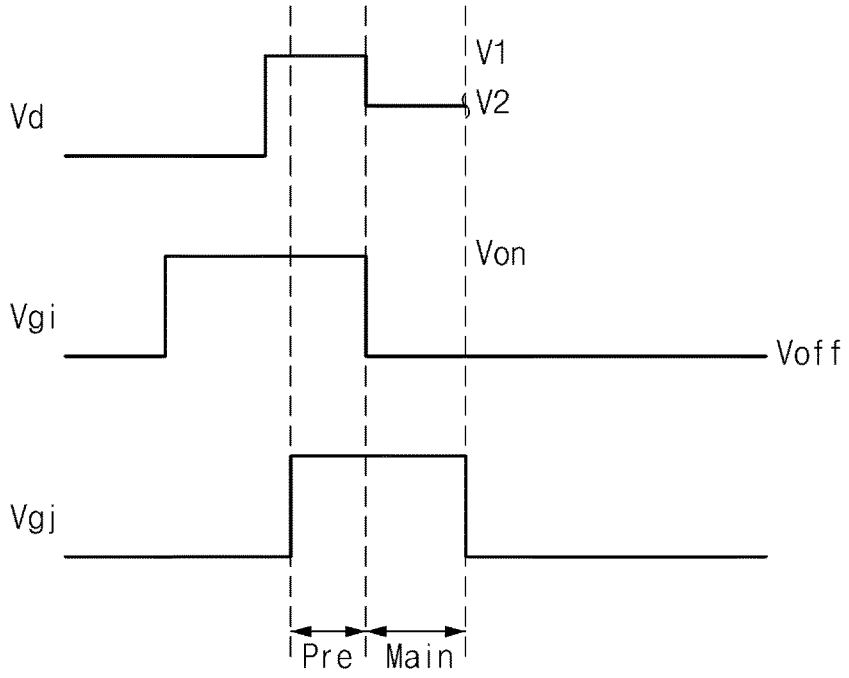

FIG. 4 is a view illustrating a pixel of a liquid crystal panel, according to an embodiment of the disclosure, FIG. 5 is a view illustrating a data voltage and a gate voltage, according to an embodiment of the disclosure, and FIGS. 6A and 6B are views illustrating a method for adjusting a delay time for each gate, according to an embodiment of the disclosure. FIG. 7 is a view illustrating a look-up table, according to an embodiment of the disclosure, and FIGS. 8A and 8B are views illustrating a process of calculating a compensation value, according to an embodiment of the disclosure.

Referring to FIG. 4, the liquid crystal panel 150 may include at least two pixels PXa and PXb connected with mutually different gate lines Gi and Gj and the same data line Dk. FIG. 4 illustrates a first pixel PXa connected with first gate lines G1 to Gn and the data lines D1 to Dm and a second pixel PXb connected with second gate lines G1 to Gn and the second gate lines G1 to Gn by way of example. These at least two pixels PXa may be positioned in mutually different lines as illustrated by the solid lines in FIG. 4, or may be positioned in one pixel line as illustrated by a dotted line in FIG. 4.

Referring to FIG. 5, the first gate lines G1 to Gn and the second gate lines G1 to Gn may transmit gate signals, and the gate-on voltages Vgi, Vgj and the like of the gate signals may be partially superposed with each other. In FIG. 5, Vd is a data voltage transferred to the first pixel PXa and the second pixel PXb, Vgi is the gate-on voltage transmitted to the first gate lines G1 to Gn, and Vgj is a gate-on voltage transmitted to the second gate lines G1 to Gn.

As illustrated in FIG. 5, a portion, which is superposed with the gate-on voltage Vgi of the first gate lines G1 to Gn, of the duration of the gate-on voltage Vgj of the second gate lines G1 to Gn is referred to as a pre-charge period Pre, and a duration, which is not superposed with the gate-on voltage Vgj of the second gate lines G1 to Gn, is referred to as a main-charge period (Main). The pre-charge period Pre of the second gate lines G1 to Gn may correspond to the main-charge period Main of the first gate lines G1 to Gn.

The first pixel PXa connected with the first gate lines G1 to Gn may be charged with a first data voltage V1, which corresponds to an output image signal of the first pixel PXa, of the data voltage Vd transmitted by the data lines D1 to Dm through the turned-on switching device, for the pre-charge period of the second gate lines G1 to Gn. In this case, the gate-on voltage Vgj is also transmitted to the switching device connected with the second pixel PXb connected with the second gate lines G1 to Gn, so even the second pixel PXb may be pre-charged with the first data voltage Vd. According to an embodiment, for the main-charge period of the second gate lines G1 to Gn, the data voltage Vd is not transmitted to the first pixel PXa, but the second pixel PXb may be main-charged with a second data voltage V2, which corresponds to an output image signal of the second pixel PXb, of the data voltage Vd through the turned-on switching device. When the liquid crystal panel 150 has the same polarity with respect to the first data voltage Vd, the second data voltage Vd, and a common voltage, the second pixel PXb is pre-charged with the first data voltage Vd in the pre-charge period Pr, so the pixel voltage of the second pixel PXb may rapidly arrive at the target brightness in the main-charge period.

According to the embodiment, the charging ratio of each pixel may be affected by the pre-charged period Pr (see FIG. 5). As illustrated in FIGS. 6A and 6B, the timing controller 120 may advance or delay the pre-charge period of each pixel corresponding to the delay time for each gate. Regarding the delay time for each gate, the pre-charge period may be overlapped with not only the main-charge period of the previous pixel but also the main-charge period of a pixel before the previous pixel (see pre-charge period Pre FIG. 6A). As described above, according to one embodiment, the charging ratio reduced due to the reduction of the scanning time may be compensated.

According to one embodiment, a pre-charged voltage varies depending on a grayscale value of a pixel affecting on the pre-charge. Accordingly, a variation in the charging ratio of the pixel (e.g., the second pixel) pre-charged depending on the position of the pixel may be made. According to one embodiment, the variation in the charging ratio made due to the reduction of the scanning time may be compensated by using the compensation value corresponding to the compensation LUT.

Referring to FIG. 7, according to an embodiment, the compensation LUT may include compensation values at areas indexed with some grayscale values 720 of pixels (e.g., the second pixel), which are pre-charged, in a first line and some grayscale values 710 of pixels (e.g., the first pixel), which affect the pre-charge, in a first column. FIG. 7 illustrates the compensation LUT including about 17 grayscale values among 256 grayscale values by way of example. According to an embodiment, in the compensation LUT, compensation values on a diagonal line, in which the grayscale values 710 of the first pixel PXa are equal to the grayscale values 720 of the second pixel PXb, may be set to '0 s'. The compensation values positioned above the diagonal line of the compensation LUT may be compensation values when grayscale values of the pixels PXb pre-charged are greater than grayscale values of pixels PXa affecting the pre-charge. The compensation values positioned below the diagonal line of the compensation LUT may be compensation values when grayscale values of the pixels PXb pre-charged are smaller than grayscale values of pixels PXa affecting the pre-charge. Each compensation value of FIG. 7 is provided by way of example, and may be varied depending on the characteristic (e.g., the scanning duration, the element characteristic, or the like) of the liquid crystal panel 150. According to another embodiment, the compensation LUT may have a value obtained by adding or subtracting a compensation value to or from the grayscale value of the second pixel PXb, which is pre-charged, instead of the compensation value, at the crossing point between the grayscale value of the pixel PXa affecting the pre-charge and the grayscale value of the pixel PXb pre-charged.

According to an embodiment, the timing controller 120 may detect a compensation value at an area indexed by a pixel, which is pre-charged, and a pixel affecting the pre-charge in the compensation LUT. According to an embodiment, the timing controller 120 may compensate for the grayscale value of a pixel pre-charged by using the detected compensation value. For example, the timing controller 120 may generate an output image signal for compensating for the charging ratio by adding the detected compensation value to a grayscale value of the input image signal when the grayscale value of the pixel pre-charged is greater than the grayscale value of the pixel affecting the pre-charge. For example, the timing controller 120 may generate an output image signal for compensating for the charging ratio by subtracting the detected compensation value from a grayscale value of the input image signal when the grayscale value of the pixel pre-charged is less than the grayscale value of the pixel affecting the pre-charge.

As illustrated in FIG. 7, the compensation LUT may include some of grayscale values of pixels. Accordingly, regarding a grayscale value not included in the compensation LUT, the timing controller 120 may calculate the compensation value using various computation schemes such as interpolation by using a grayscale value approximate to the grayscale value not included in the compensation LUT. According to an embodiment, the data storage space may be saved through the above configuration.

Hereinafter, the calculation of the compensation value using the interpolation will be described with reference to FIGS. 8A and 8B.

As illustrated in FIG. 8A, when the grayscale value of the pixel PXa affecting the pre-charge is 8 and the grayscale value of the pixel PXb pre-charged is 56 in the compensation LUT, the timing controller 120 may calculate coordinates, (0, 48), (0, 64), (16, 48), and (16, 64) of four grayscale values around the grayscale values of '8' and '56', and may calculate compensation values L1, L2, L3, and L4 corresponding to the coordinates. In this case, as illustrated in FIG. 8B, the timing controller 120 may obtain a compensation value of '7' through the linear interpolation using four compensation values L1, L2, L3, and L4 (see numbers marked in a square shape of FIG. 8B).

Figure 9:
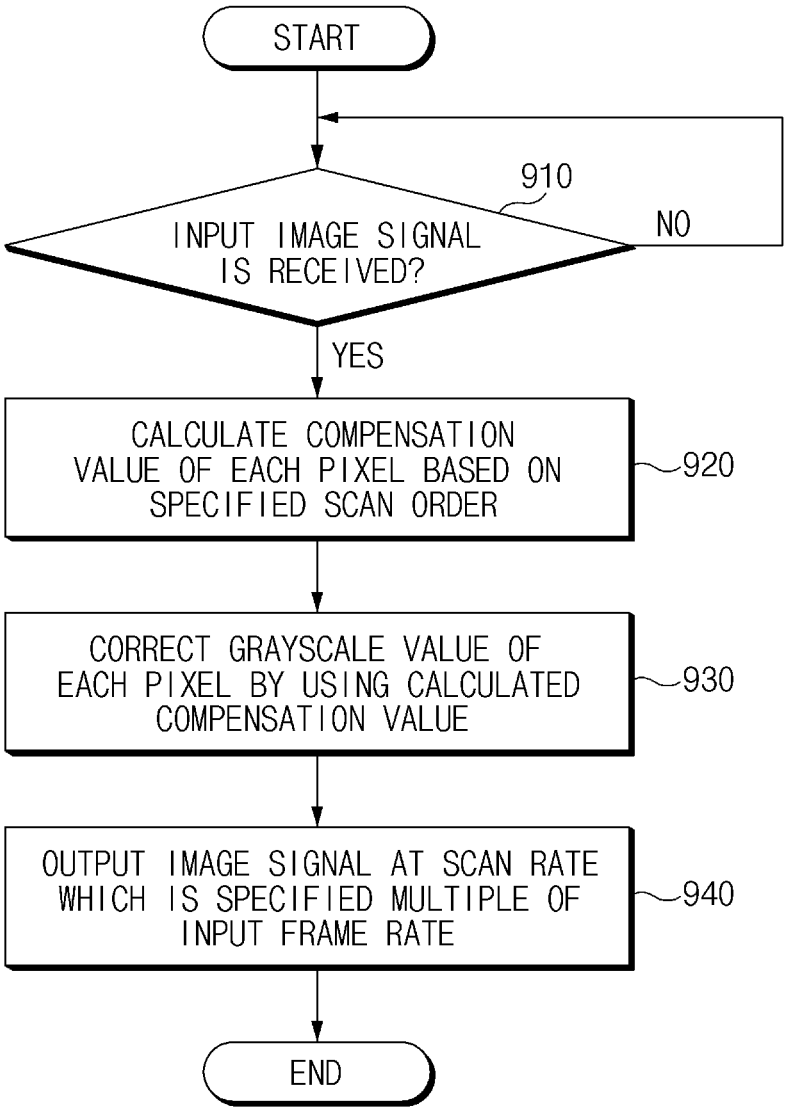
FIG. 9 is a flowchart illustrating a method for scanning a liquid crystal panel, according to an embodiment of the disclosure.

FIG. 9 is a flowchart illustrating a method for scanning a liquid crystal panel, according to an embodiment of the disclosure.

Referring to FIG. 9, in operation 910, the timing controller 120 may determine whether an input image signal is received. For example, the timing controller 120 may receive the input image signal from the graphic control unit 110.

In operation 920, when the input image signal is received, the timing controller 120 may determine the compensation value of each pixel based on a scan order specified for the liquid crystal panel 150. In operation 920, the timing controller 120 may determine the compensation value of each pixel based on the grayscale values of a pixel pre-charged and a pixel affecting the pre-charge. For example, the timing controller 120 may identify a pixel pre-charged, a pixel affecting the pre-charge, and the grayscale values of the pixels, based on the scan order of the liquid crystal panel 150 and may search the compensation LUT for compensation values indexed with a grayscale value of each pixel of the output image signal and a grayscale value affecting the charging of each pixel. The timing controller 120 may calculate a compensation value to be applied by using an interpolation scheme, with respect to a grayscale value absent in the compensation LUT.

In operation 930, the timing controller 120 may correct the grayscale value of the image signal using the calculated compensation value.

In operation 940, the timing controller 120 may output an image signal at a scan rate that is a specified multiple (e.g., two times) of the frame rate corresponding to the input control signal. For example, the timing controller 120 may generate a data control signal that is twice greater than a dot clock corresponding to the input control signal, and may output the corrected image signal to the data driving unit 130 in response to the generated double-speed data control signal. The timing controller 120 may generate a gate control signal that is twice greater than the dot clock corresponding to the input control signal and may adjust a turn-on time of each gate in response to the generated double-speed gate control signal. In one embodiment, the timing controller 120 may identify the scan order of the liquid crystal panel 150 and may output a gate control signal depending on the delay time for each gate based on the first scanned gate. In this case, the timing controller 120 may always turn on the first scanned gate at the same time point.

According to an embodiment of the disclosure, as a liquid crystal scan time is reduced in each frame period, a blank duration may be increased after the scanning of liquid crystal is finished. Accordingly, a data bandwidth may be increased.

At least a part of a device (e.g., modules or functions thereof) or a method (e.g., operations) according to various embodiments may be, for example, implemented by instructions stored in a computer-readable storage media in the form of a program module. When the instruction is executed by a graphic control unit, the graphic control unit may perform a function corresponding to the instruction. A computer-readable recording medium may include a hard disk, a floppy disk, a magnetic media (e.g., a magnetic tape), an optical media (e.g., a compact disc read only memory (CD-ROM) and a digital versatile disc (DVD), a magneto-optical media (e.g., a floptical disk)), and an embedded memory. The instructions may include codes formed by a compiler or codes executable by an interpreter. According to various embodiments, a module or a program module may include at least one or more of the above-mentioned components, some of the above-mentioned components may be omitted, or another component may be further included therein.

According to various embodiments, operations performed by modules, program modules, or other components may be executed by a successive method, a parallel method, a repeated method, or a heuristic method, at least some operations may be executed in a difference sequence or omitted, or another operation may be added. Embodiments disclosed in the disclosure are provided for the illustrative purpose and the technical scope described in the disclosure is not limited thereto. Accordingly, the technical scope of the disclosure should be interpreted as including all modifications or various changes based on the technical spirit of the disclosure.

The invention claimed is:

1. A display device comprising:

a liquid crystal panel;

a backlight including at least one light source to irradiate light to the liquid crystal panel;

a timing controller to scan, in each frame period based on a synchronization signal which is input, the liquid crystal panel at a scan rate faster than a frame rate based on the synchronization signal;

a dimming control unit configured to output a backlight control signal; and a backlight control unit configured to turn on the backlight until a second time point, which is a scan time point of a next frame, from a first time point when a specified time elapses from a time point at which scan of the liquid crystal panel is finished in each frame period, wherein the backlight control unit is configured to turn on and off the backlight in response to the backlight control signal, and wherein the dimming control unit is configured to:

identify a motion size of each image frame transmitted to the timing controller, detect a blurring area, which has a higher motion blur possibility, of a plurality of detection areas, based on the identified motion size, and adjust the specified time based on a scan order of the blurring area in the liquid crystal panel.

2. The display device of claim 1, wherein the backlight control unit is configured to simultaneously turn on and turn off all light sources included in the backlight.

3. The display device of claim 1, wherein the backlight control unit is configured to turn on and turn off the backlight at least one time from the first time point to the second time point.

4. The display device of claim 1, wherein the timing controller is configured to scan the liquid crystal panel at a scan rate twice or more faster than the frame rate.

5. The display device of claim 1, wherein the first time point is a time point at which charging of the liquid crystal panel is finished.

6. The display device of claim 1, wherein the dimming control unit is configured to increase the specified time as the scan order of the blurring area becomes later from an area, which is first scanned, in the plurality of detection areas.

7. The display device of claim 1, wherein the dimming control unit is configured to output a signal for turning on the backlight at a time point at which output of an image signal is finished, when the blurring area is not detected or when the blurring area has an earliest scan order in the detection areas.

8. The display device of claim 1, further comprising:

a memory having a compensation look-up table to store a list of compensation values of grayscale values corresponding to a grayscale value of a pixel pre-charged and a grayscale value of a pixel affecting pre-charge based on the scan order of the liquid crystal panel, wherein the timing controller is configured to search the compensation look-up table for compensation values corresponding to a grayscale value of each of pixels, which are pre-charged and a grayscale value of a pixel affecting the pre-charge of each of the pixels, and correct the grayscale value of each of the pixels by using the compensation values which are found.

9. The display device of claim 8, wherein the compensation look-up table includes some of the grayscale values of the pixels, and wherein the timing controller is configured to calculate, when at least one of the grayscale value of each of the pixels or the grayscale value of the pixel affecting the pre-charge of each of the pixels is absent from the compensation look-up table, a compensation value for the grayscale value of each of the pixels by performing interpolation using a plurality of grayscale values close to the at least one grayscale value.

10. The display device of claim 1, further comprising:

a memory configured to store a delay time for each of gates for compensating for a shortage of a charging ratio identified based on the scan rate, wherein the timing controller is configured to adjust a time to turn on each of the gates of the liquid crystal panel depending on the delay time for each of the gates based on a scan order.

11. A display method by at least one processor, the display method comprising:

scanning, in each frame period based on a synchronization signal which is input, a liquid crystal panel at a scan rate faster than a frame rate based on the synchronization signal; and turning on a backlight until a second time point, which is a scan time point of a next frame, from a first time point when a specified time elapses from a time point at which scan of the liquid crystal panel is finished in each frame period, wherein the turning on of the backlight includes;

identifying a motion size of each image frame to be output to the liquid crystal panel;

detecting a blurring area, which has a higher motion blur possibility, of a plurality of detection areas, based on the identified motion size; and adjusting the specified time based on a scan order of the blurring area in the liquid crystal panel.

12. The display method of claim 11, wherein the adjusting of the specified time includes:

identifying the scan order of the blurring area based on an area, which is first scanned, in the plurality of detection areas; and delaying the specified time as the scan order of the blurring area is later from the first scanned area.

* * * * *